United States Patent [19]

Fujiwara et al.

[11] Patent Number: 4,769,999

[45] Date of Patent: Sep. 13, 1988

[54] LIQUID-GAS CONTACTOR FOR NON-AZEOTROPIC MIXTURE REFRIGERANT

[75] Inventors: Katsuhiko Fujiwara; Masahiko Kagami; Takumi Imoto, all of Kusatsu; Naoki Shimokawa, Shiga, all of Japan

[73] Assignee: Matsushita Electric Industrial Co., Ltd., Osaka, Japan

[21] Appl. No.: 113,961

[22] Filed: Oct. 29, 1987

[30] Foreign Application Priority Data

Oct. 30, 1986 [JP] Japan ..... 61-258809
Oct. 31, 1986 [JP] Japan ..... 61-261297

[51] Int. Cl.[4] ..... F25B 1/00
[52] U.S. Cl. ..... 62/114; 62/198
[58] Field of Search ..... 62/17, 18, 114, 198

[56] References Cited

U.S. PATENT DOCUMENTS

| | | | |
|---|---|---|---|
| 1,883,899 | 10/1932 | Harris | 62/114 |
| 4,183,225 | 1/1980 | Politte et al. | 62/114 |
| 4,423,603 | 1/1984 | Oguni et al. | 62/114 |
| 4,464,190 | 8/1984 | Gulsby | 62/24 |

*Primary Examiner*—Ronald C. Capossela
*Attorney, Agent, or Firm*—Spencer & Frank

[57] ABSTRACT

A gas-liquid contactor for varying the mixing ratio of a non-azeotropic refrigerant circulated through a refrigeration cycle. A liquid returning pipe leading from a liquid refrigerant reservoir has a lower end which is opened downward into the container of the gas-liquid contactor at a position substantially on the axis of the container, so that the returned liquid refrigerant can be uniformly distributed over the entire region of the filler bed so as to enhance exchange of heat between the gaseous phase and the liquid phase of the refrigerant. A lower filler holder defining the lower end of a bed of filler in the gas-liquid contactor is convexed upward at its central portion so as to smoothly guide the flow of gaseous phase of the refrigerant into the filler bed.

4 Claims, 1 Drawing Sheet

LIQUID-GAS CONTACTOR FOR NON-AZEOTROPIC MIXTURE REFRIGERANT

BACKGROUND OF THE INVENTION

The present invention relates to a liquid-gas contactor for use with a non-azeotropic mixture refrigerant.

FIG. 2 shows an example of a refrigeration cycle which makes use of a non-azeotropic mixture refrigerant composed of two or more refrigerants such as, for example, R13B1 and R22. FIG. 3 shows the construction of a gas-liquid contactor which is used for changing the mixing ratio of the refrigerants in the non-azeotropic mixture refrigerant.

Referring to FIG. 2, the refrigeration cycle includes a compressor 1, a condenser 2, a first orifice means 3, a second orifice means 4, an evaporator 5, a gas-liquid contactor 6, a cooler 7, and a reservoir 8.

Referring now to FIG. 3, the gas-liquid contactor 6 has a container 9, a connection pipe 10 through which the container 9 is connected to the upstream side of the gas-liquid contactor 6 in the refrigeration cycle, a connection pipe 11 through which the container 9 is connected to the downstream side of the gas-liquid contactor in the refrigeration cycle, lower and upper filler holders 12, 13, filler 14, a gas outlet pipe 15, and a liquid return pipe 16 leading from the reservoir 8.

In operation of the refrigeration cycle shown in FIG. 2, the mixture refrigerant compressed and discharged from the compressor 1 is recirculated as indicated by an arrow and is returned to the compressor 1. During recirculation, the refrigerant discharged from the compressor 1 is condensed and liquefied in the condenser 2 and the condensate of the refrigerant is expanded through the first orifice device 3 so that a part of the mixture refrigerant is evaporated. The gaseous phase of the refrigerant generated in the first orifice device 3 is introduced through the connection pipe 10 to the gas-liquid contactor 6 and ascends through the tiny spaces formed in the bed of the filler 14 so as to flow through the gas outlet pipe 15 into the cooler 7 where it is cooled and liquefied again to flow into the reservoir 8.

A portion of the liquid phase of the refrigerant is returned from the reservoir 8 to the gas-liquid contactor 6 through the liquid return pipe 16 and flows down through the tiny spaces in the bed of filler 14 so as to contact with the gaseous phase of the refrigerant flowing upward through these spaces. As a result, heat is exchanged between the liquid and gaseous phases of the refrigerant, whereby the mixing ratio of the recirculated refrigerant is changed.

Thus, the mixing ratio of the mixture refrigerant recirculated through the refrigeration cycle is varied by the gas-liquid contactor. The range of variation of the mixing ratio is ruled by the performance of the gas-liquid contactor 6. More specifically, the range over which the mixing ratio is changed is increased by promoting the heat exchange through attaining a greater chance of contact between the liquid and gaseous phases of the refrigerant. This can be achieved by increasing the area of contact between two phases of the refrigerant. It is therefore desirable that the gas-liquid contactor is designed to invite a greater quantity of gaseous phase of the refrigerant.

The construction of the gas-liquid contactor 6 shown in FIG. 3 suffers from a problem in that, since the position of the liquid returning pipe 16 leading from the reservoir 8 is offset from the center of the container 9, a local concentration of the liquid phase of the refrigerant tends to occur through the filler bed. This hampers uniform distribution of the liquid phase, with the result that the gas-liquid contact cannot be conducted uniformly over the entire region of the filler bed.

In addition, since the lower filler holder 12 is so designed as to extend perpendicularly to the direction of flow of the gaseous phase of the refrigerant introduced through the connection pipe 10 leading from an upstream portion of the refrigeration cycle, the lower filler holder 12 poses a large resistance against the gaseous phase of the refrigerant entering the bed of the filler 14 through the holes in the lower filler holder 12. In consequence, a considerable portion of the gaseous phase of the refrigerant introduced through the connection pipe 10 is made to flow directly to the downstream side of the gas-liquid contactor in the refrigeration cycle through the connection pipe 11, without entering the bed of the filler. In consequence, the area of the gas-liquid contact is decreased to reduce the range of variation of the mixing ratio.

SUMMARY OF THE INVENTION

Accordingly, an object of the present invention is to provide an improved gas-liquid contactor for use in a refrigeration cycle which operates with nonazeotropic mixture refrigerant, which is capable of widening the range over which the mixing ratio of recirculated refrigerant is variable.

To this end, according to the present invention, there is provided a gas-liquid contactor for varying the mixing ratio of a non-azeotropic refrigerant circulated through a refrigeration cycle, wherein the liquid returning pipe has a lower end which is opened downward into the container of the gas-liquid contactor at a position substantially on the axis of the container, so that the returned liquid refrigerant can be uniformly distributed over the entire region of the filler bed so as to enhance exchange of heat between the gaseous phase and the liquid phase of the refrigerant.

In a preferred form of the invention, the lower filler holder is convexed upward substantially at its central portion towards the filler so as to smoothly guide the gaseous phase of the refrigerant into the bed of the filler.

The above and other objects, features and advantages of the invention will become clear from the following description of the preferred embodiments when the same is read in conjunction with the accompanying drawings.

DESCRIPTION OF THE PREFERRED EMBODIMENTS

Figure 1:
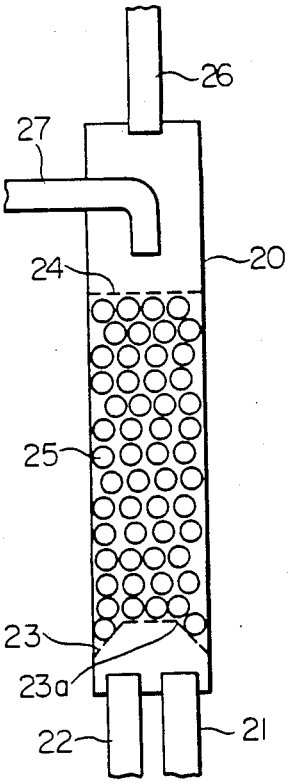
FIG. 1 is a sectional view of a gas-liquid contactor embodying the present invention.
Figure 3:
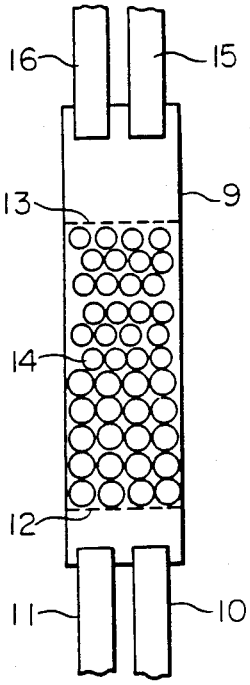
FIG. 3 PRIOR ART
FIG. 3 is a sectional view of a known gas-liquid contactor.
Figure 2:
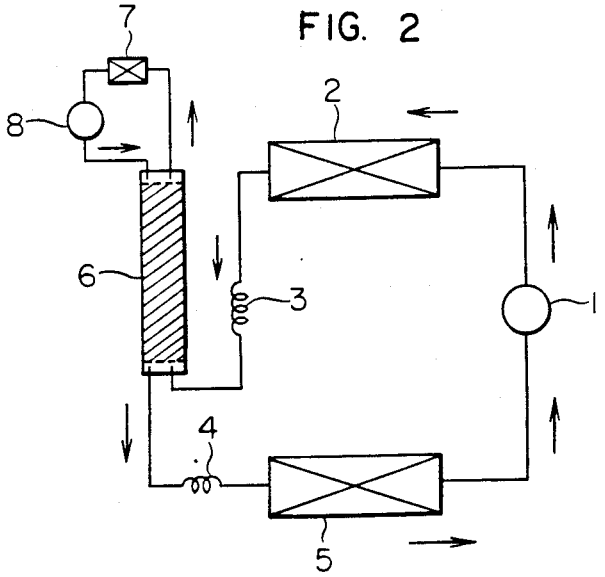
FIG. 2 is a diagram of a refrigeration cycle which incorporates the gas-liquid contactor of the present invention.

FIG. 1 shows an embodiment of the gas-liquid contactor of the invention, while FIG. 2 shows a refrigeration cycle incorporating the gas-liquid contactor.

Referring to FIG. 2, the gas-liquid contactor embodying the present invention has a container 20, a connection pipe 21 through which the container 20 is connected to the upstream side of the gas-liquid contactor in the refrigeration cycle, a connection pipe 22 through which the container 20 is connected to the downstream side of the gas-contactor in the refrigeration cycle, lower and upper filler holders 23, 24 having a multiplicity of apertures, a bed of filler 25 completely filling the space between the lower and upper filler holders 23, 24, a gas outlet pipe 26, and a liquid returning pipe 27 leading from the reservoir and extended into the container 20 through an upper portion of the side wall of the container 20. The lower end of the liquid returning pipe 27 is bent such that the lower end opening thereof is located substantially on the axis of the container 20 such as to open downward. The lower filler holder 23 is convexed upward at its central portion as denoted by 23*a*.

In operation, the refrigerant condensed in the condenser 2 of the refrigeration cycle and now in liquid phase is expanded through the first orifice device 3 so that a part of the refrigerant is evaporated into the gaseous phase. The gaseous phase of the refrigerant thus formed is introduced into the gas-liquid contactor 6 through the connecting pipe 21 and ascends through tiny spaces in the bed of the filler 25. The gaseous phase of the refrigerant then flows through the gas outlet pipe 26 into the cooler 7 where it is cooled to become a liquid refrigerant which is then reserved in the reservoir 8.

A portion of the liquid refrigerant in the reservoir 8 is returned through the liquid returning pipe 27 into the gas-liquid contactor 6 and flows downward through the tiny spaces in the bed of the filler 25 so as to make gas-liquid contact with the gaseous phase flowing upward through the same tiny spaces, thereby varying the mixing ratio of the recirculated refrigerant through heat exchange and transition the of substance.

The refrigerant with varied mixing ratio is then introduced through the connecting pipe 22 into the second orifice device 4 so as to be expanded through the latter and then flows into the evaporator 5.

The liquid returning pipe 27 leading from the reservoir 8 may be extended into the container 20 through the top end of the container 20 provided that the diameter of the container 20 is sufficiently small. Since the lower end of the liquid returning pipe 27 is opened downward at a position which is substantially on the axis of the container 20, the returning liquid can flow through the filler 25 with reduced tendency of local concentration, so that the gas-liquid contact can be effected over the entire region of the bed of the filler 25, thus enlarging the area of the gas-liquid contact.

In addition, since the central portion of the lower filler holder 23 is convexed upward as denoted by 23*a* towards the filler 25, the lower filler holder 23 produced only a small resistance against the flow of the gaseous refrigerant introduced into the gas-liquid contactor 6. As a result, a greater portion of the gaseous phase of refrigerant introduced into the gas-liquid contactor 6 is allowed to flow into the bed of the filler 25, so as to increase the area of the gas-liquid contact thereby enhancing the heat exchange between both phases of the refrigerant. As a result, the performance of the filler is fully utilized so as to widen the range of variation of the mixing ratio.

In consequence, a large heat-exchanging capacity is produced by the combination of the arrangement of the downward opening of the liquid returning pipe 27 and the upward convexity of the central portion of the lower filler holder 23, so as to enable the mixing ratio to be varied over a wide range.

As has been described, according to the present invention, the liquid phase of the refrigerant returned to the gas-liquid contactor can be uniformly distributed over the entire region of the bed of the filler so that the effective area for the gas-liquid contact is enlarged to enable the mixing ratio to be varied over a wide range. In addition, the permeation of the gaseous phase of the refrigerant into the bed of the filler is enhanced so as to increase the area of the gas-liquid contact, contributing to the widening of the range of variation of the mixing ratio.

What is claimed is:

1. A gas-liquid contactor for use in a refrigeration cycle having a compressor, a condenser, an orifice means and an evaporator which are connected through pipes in the form of a loop through which a non-azeotropic refrigerant composed of two or more refrigerants of different boiling temperatures is circulated, said gas-liquid contactor comprising:

a substantially cylindrical container;

a first pipe connected to a lower portion of said container upstream of said gas-liquid contactor in said refrigeration cycle;

a second pipe connected to a lower portion of said container downstream said gas-liquid contactor of said refrigeration cycle;

a gaseous refrigerant outlet pipe connected to an upper portion of said container;

a liquid refrigerant returning pipe connected to an upper portion of said container and having a lower end opened downward at a position substantially on the axis of said container;

upper and lower filler holders disposed in an upper portion and a lower portion of said container and each having a multiplicity of through-holes; and a bed of a filler defined between said upper and lower filler holders and charged with a filler.

2. A gas-liquid contactor according to claim 1, wherein said liquid returning pipe extends into said container through an upper portion of the side wall of said container.

3. A gas-liquid contactor for use in a refrigeration cycle having a compressor, a condenser, an orifice means and an evaporator which are connected through pipes in the form of a loop through which a non-azeotropic refrigerant composed of two or more refrigerants of different boiling temperatures is circulated, said gas-liquid contactor comprising:

a substantially cylindrical container;

a first pipe connected to a lower portion of said container upstream of said gas-liquid contactor in said refrigeration cycle;

a second pipe connected to a lower portion of said container downstream of said gas-liquid contactor in said refrigeration cycle;

a gaseous refrigerant outlet pipe connected to an upper portion of said container;

a liquid refrigerant returning pipe connected to an upper portion of said container and having a lower end opened downward at a position substantially on the axis of said container;

upper and lower filler holders disposed in an upper portion and a lower portion of said container and each having a multiplicity of through-holes, said lower filler holder being convexed upward at its central portion; and a bed of a filler defined between said upper and lower filler holders and charged with a filler.

4. A gas-liquid contactor according to claim 3, wherein said liquid returning pipe extends into said container through an upper portion of the side wall of said container.

* * * * *